US006626012B2

(12) United States Patent
Spielmann et al.

(10) Patent No.: US 6,626,012 B2
(45) Date of Patent: Sep. 30, 2003

(54) METHOD AND KNITTING MACHINE FOR RECTILINEAR KNITTING TO FORM A TUBULAR SEAMLESS KNITTED MATERIAL

(76) Inventors: Anton Percy Spielmann, Chemin du Port-de-Bellerive, CH-1201 Geneva (CH); William Steven Spielmann, Chemin du Port-de Bellerive, CH-1201 Geneva (CH)

( * ) Notice: Subject to any disclaimer, the term of this patent is extended or adjusted under 35 U.S.C. 154(b) by 22 days.

(21) Appl. No.: 10/218,805

(22) Filed: Aug. 14, 2002

(65) Prior Publication Data

US 2002/0194883 A1 Dec. 26, 2002

Related U.S. Application Data

(63) Continuation of application No. PCT/IB01/00232, filed on Feb. 21, 2001.

(30) Foreign Application Priority Data

Feb. 23, 2000 (EP) ..... 00810150

(51) Int. Cl.[7] ..... D04B 7/04

(52) U.S. Cl. ..... 66/64

(58) Field of Search ..... 66/64, 8, 13, 1 R, 66/75.1

(56) References Cited

U.S. PATENT DOCUMENTS

| | | | | |
|---|---|---|---|---|
| 3,456,459 A | | 7/1969 | Doughty | |
| 5,226,297 A | * | 7/1993 | Manini | 66/13 |
| 6,196,030 B1 | * | 3/2001 | Stoll et al. | 66/178 R |

FOREIGN PATENT DOCUMENTS

| | | |
|---|---|---|
| DE | 18031 C | 6/1882 |
| DE | 358971 | 9/1922 |
| DE | 20 12 714 | 10/1971 |
| EP | 0 552 588 | 7/1993 |
| EP | 0 905 298 | 3/1999 |

* cited by examiner

*Primary Examiner*—Danny Worrell
(74) *Attorney, Agent, or Firm*—Sturm & Fix LLP

(57) ABSTRACT

The invention concerns a knitting machine comprising two needle beds for guiding knitting needles, means for selecting said knitting needles, carriages for moving the selected knitting needles and members guiding the knitting thread. The method consists in arranging the needle beds so that the needles of a needle bed in their normal knitting travel do not cross the needles of the other needle bed, in moving the carriage in one direction along each needle bed, the displacement directions of said carriages along their respective needle beds being opposite relative to each other and in transferring the thread from the needles of one needle bed to those of the other needle beds, each time said thread reaches the end of the selected needles.

13 Claims, 13 Drawing Sheets

VIa
VIa
VIb
VIb
10
10a
10b
10c
12
12a
12b
13
13a
8
9
9a
14
15
15a
15b
17
18
19a
19b
19c
19d
20
21a
21b
21c
21d
23
24
32
52

METHOD AND KNITTING MACHINE FOR RECTILINEAR KNITTING TO FORM A TUBULAR SEAMLESS KNITTED MATERIAL

CROSS REFERENCE TO RELATED APPLICATIONS

This application is a Continuation application of PCT/IB01/00232 filed Feb. 21, 2001, which claimed priority of European Patent Application No. 00810150.3 filed Feb. 23, 2000, entitled "Method and Knitting Machine for Rectilinear Knitting to Form a Tubular Seamless Knitted Material" which are included in their entirety by reference made hereto.

BACKGROUND OF THE INVENTION

1. Field of the Invention

The present invention relates to a method for forming a seamless tubular knit on a rectilinear knitting machine comprising two sections for guiding the knitting needles, means of selecting these knitting needles, carriages for displacing the selected knitting needles and members for guiding the knitting yarn, and to a rectilinear knitting machine for implementing this method.

2. Description of the Related Art

Conventional rectilinear knitting machines could possibly knit seamless tubular articles, with a few modifications, especially articles formed from two tubular elements joined into a single tubular element, such as a pair of pants. However, they are not able to produce such articles with a sufficiently dense knit to make trouser fabric. Nor do they allow production under economically viable conditions, since the production rate would be so much smaller. Circular machines do not allow either the production of tubular elements side by side, or the production of tubular elements of variable diameters, or else elements which depend on the uniformity of the knit, by varying, for example, the tension of the yarn, the density of the stitches, etc.

The aim of the present invention consists in producing a seamless tubular knit on a rectilinear knitting machine, capable of overcoming, at least in part, the aforementioned drawbacks.

BRIEF SUMMARY OF THE INVENTION

To this end, the object of the present invention is first of all a method of forming a seamless tubular knit on a rectilinear knitting machine of the aforementioned type, as defined by claim 1.

Preferably, this method relates to the formation of two tubular bodies then joined into a single tubular body, making it possible to produce a seamless pair of pants.

The subject of this invention is also a knitting machine for implementing the knitting method, as defined in claim 3, and a pair of pants, boxer shorts or tights obtained by implementing this method.

This invention has the advantage of allowing the manufacture of a novel product under favorable economic conditions. A seamless pair of pants or boxer shorts, whatever the size, is in fact an unknown article, given that it is not yet known how to produce it.

It should be noted that one of the advantages of the method which is the subject of the invention resides in the fact that the diameter of the tubular part or parts of this article may vary so as to give the latter the desired shape.

In fact, as will be realized during the following description, the knitting method according to the invention cannot be implemented on a conventional rectilinear knitting machine, but requires a novel rectilinear machine concept, thus explaining that it is only by imagining a novel knitting concept, radically different from that usually implemented in rectilinear knitting machines, that the invention has been able to see the light of day. Indeed, it was necessary to create a concept making it possible to knit two different knitted webs, one on each section, while continually joining them by a transfer of the knitting yarn from one section to the other, thus allowing the formation of a seamless tubular element. Starting from this principle, it becomes possible to imagine the simultaneous production of two tubular elements side by side, which can then be joined into a single tubular element by selecting the needles separating the two tubular elements.

The invention will be better understood on referring to the following description and to the appended drawings which illustrate, schematically and by way of example, two implementational modes of the method which is the subject of the present invention, relating to two embodiments of the machine which is also subject of this invention.

DETAILED DESCRIPTION OF THE PREFERRED EMBODIMENTS

Figure 1:
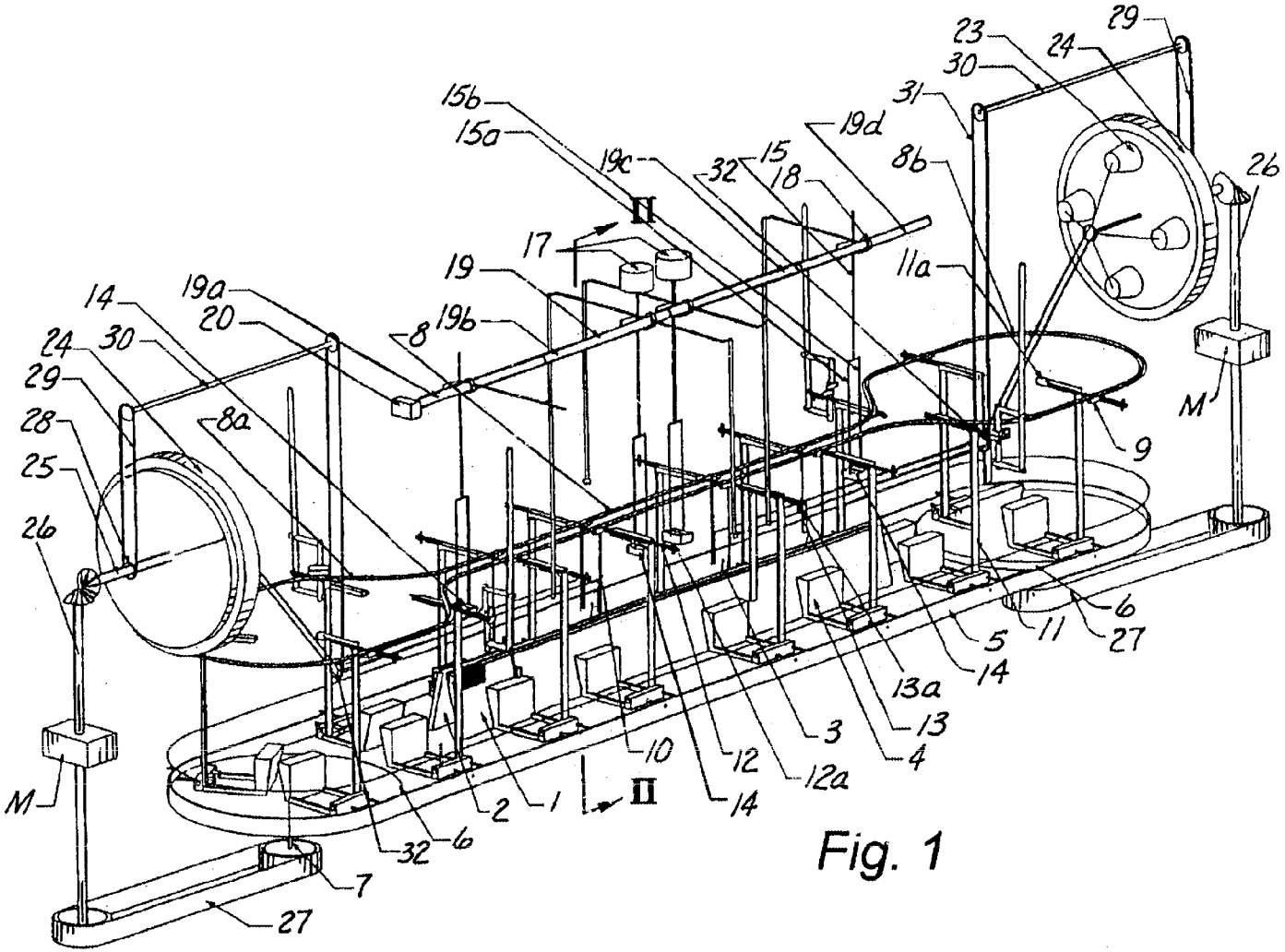
FIG. 1 is a perspective view of a knitting machine according to the first embodiment.
Figure 2:
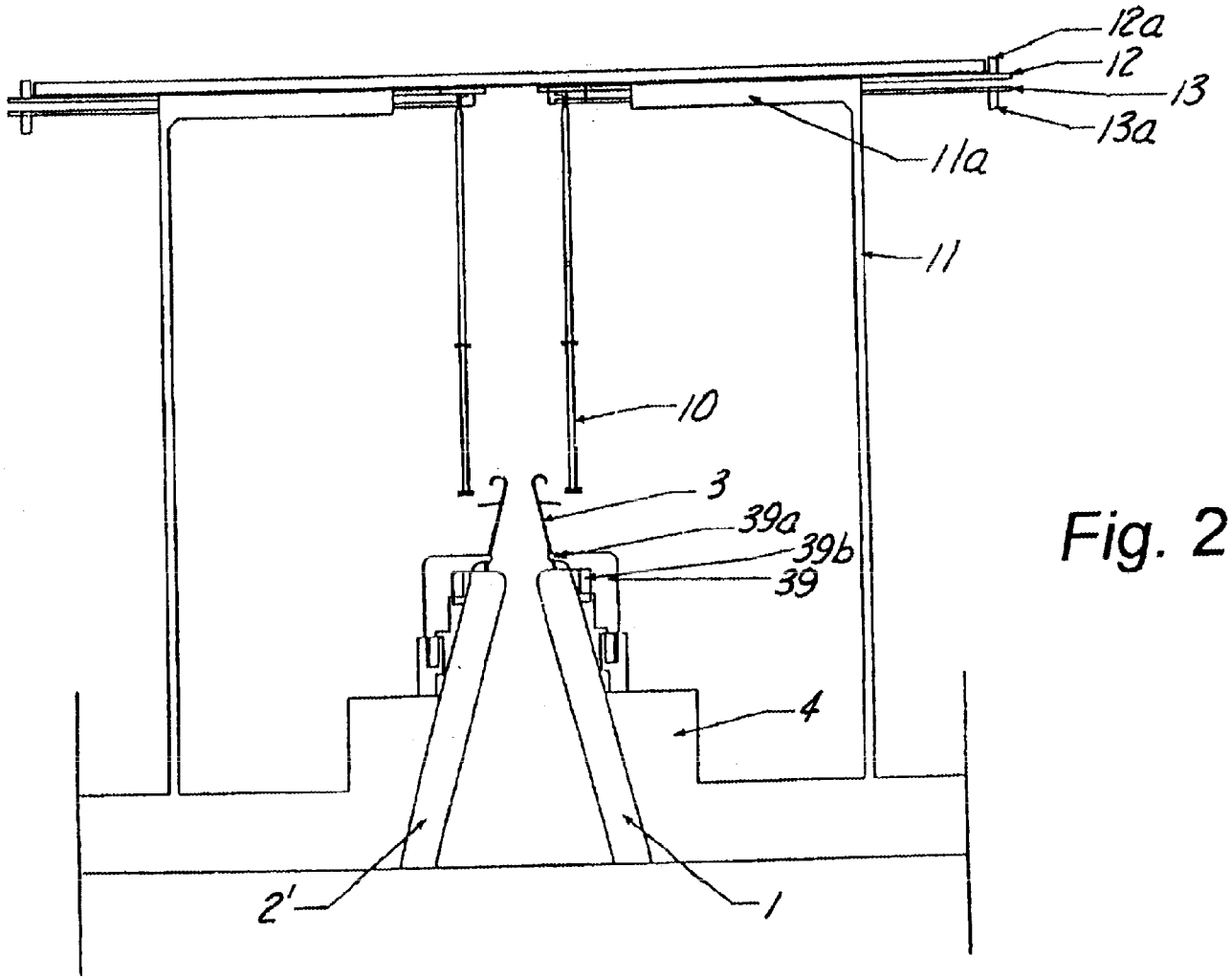
FIG. 2 is a view in transverse section along the line II—II of FIG. 1.
Figure 3:
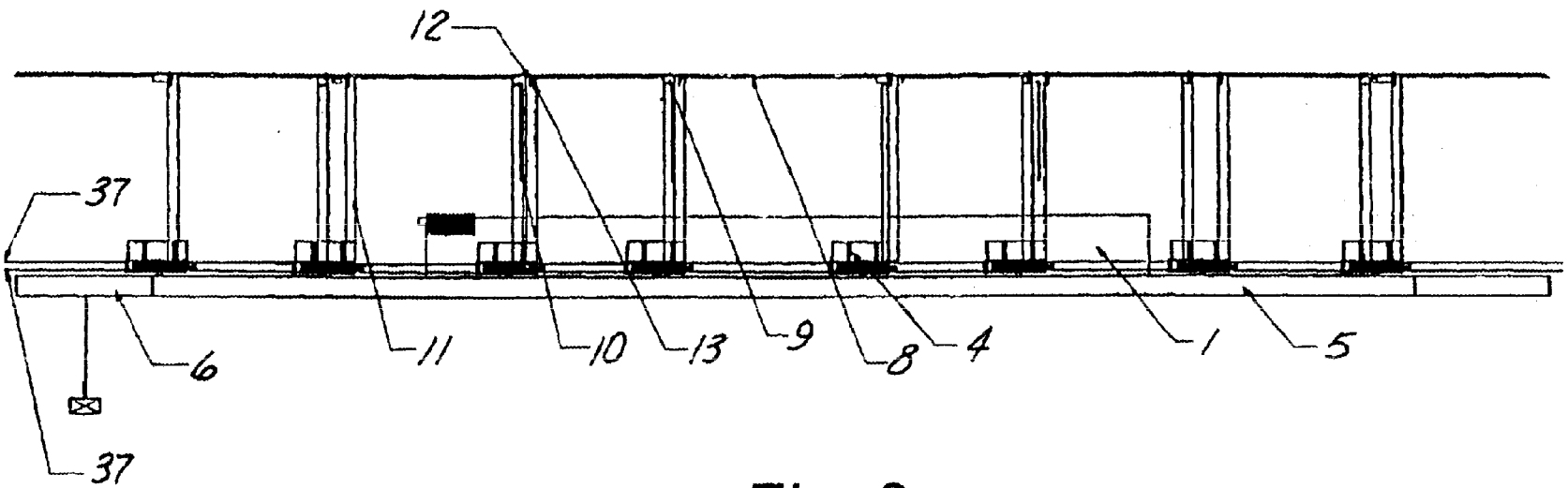
FIG. 3 is a view in side elevation of FIG. 1.

The knitting machine illustrated in FIG. 1 is a rectilinear machine comprising two sections 1, 2, which form either two parallel planes or, as illustrated in this FIG. 1, the planes of these sections form an acute angle with each other such that the knitting needles 3, in their normal knitting travel, do not cross, as illustrated in FIG. 2.

It is stated that only the parts of the machine needed for understanding the invention have been shown. The usual parts of this type of machine, well known to a person skilled in the art and which are not part of the present invention have therefore not been shown. This is especially the case for the knitting needle 3 selection mechanism, and the cam mechanisms for controlling the needles secured to the carriages.

A plurality of carriages 4 are placed along the sections 1, 2. These carriages 4 are secured to a drive chain or belt 5. This drive chain 5 forms a closed loop which rotates around two drive disks 6, mounted so that they can rotate about two respective vertical shafts, one 7 of which is visible in FIG. 1. The carriages, secured to this drive chain 5, therefore always advance in the same direction. In the example described, this direction is that of the arrow F, such that these carriages 4 pass successively from one section 1 to the other section 2 and conversely.

Figures 6, 6A, 6B, 6C:
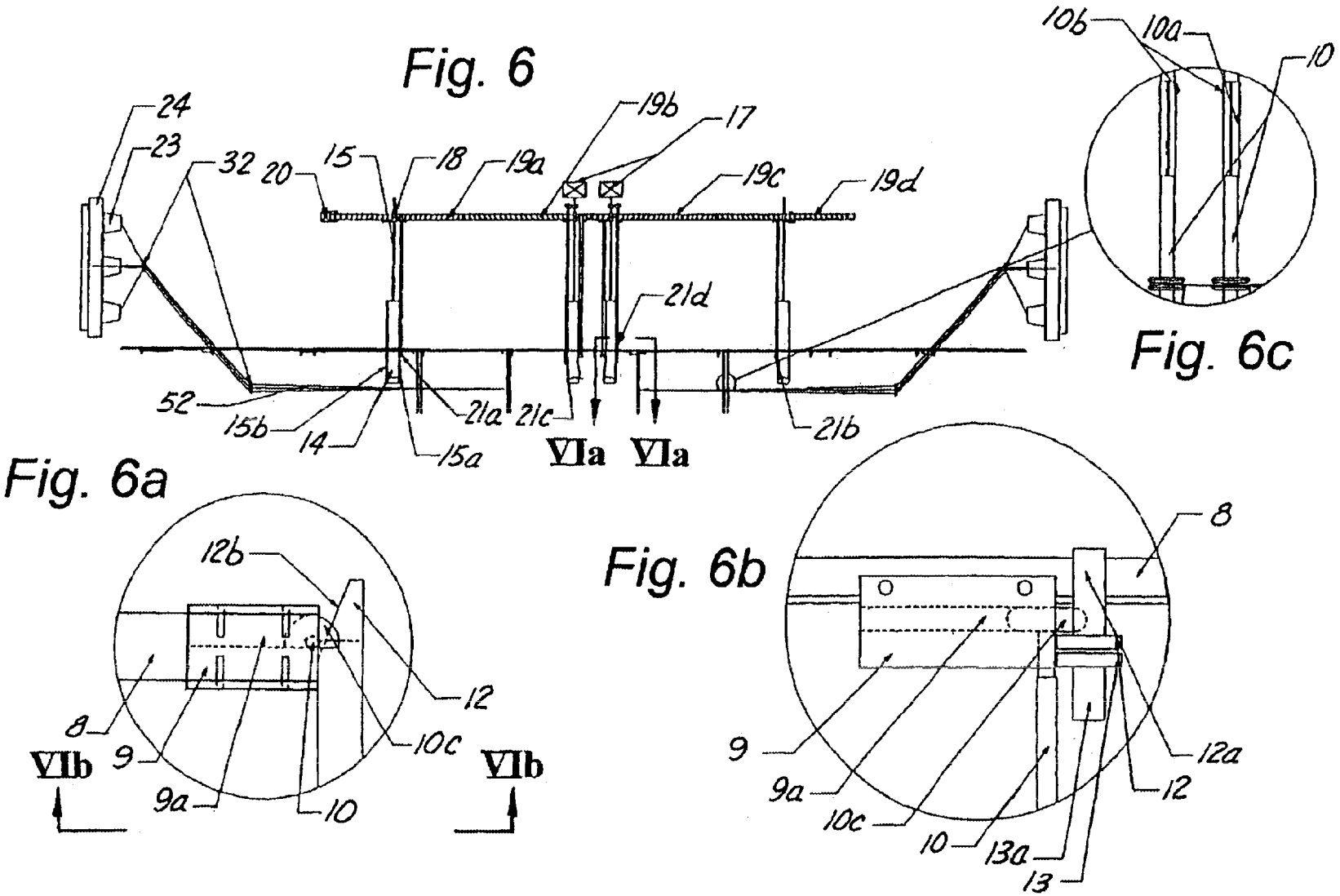
FIG. 6 is an elevated view of FIG. 5.
FIG. 6*a* is a view of a detail of FIG. 6.
FIG. 6*b* is a top view of the detail of FIG. 6*a;*
FIG. 6*c* is an enlarged view of a detail of FIG. 6.

A guide rail 8 forms a closed loop whose plane is parallel and located above the closed loop, formed by the drive chain 5. Sliding supports 9, illustrated in more detail in FIGS. 6*a*, 6*b*, are engaged with the guide rail 8 and are capable of sliding freely along this rail. A yarn guide 10 is suspended on each sliding support 9. To this end, the upper end of the yarn guide 10 is terminated by a semicircular catching element 10*c*, while the sliding support 9 comprises a longitudinal catching groove 9*a* open at its two ends, in order to allow the catching element 10*c* to exit via the rear of this longitudinal groove 9*a* and to re-enter via the front, with respect to the displacement direction of the sliding support 9.

Each carriage 4 bears a bracket 11, the horizontal arm 11*a* of which extends just under the guide rail 8. This horizontal arm 11*a* forms a slide in which two pushers, an upper pusher 12 and a lower pusher 13, are mounted so that they can slide, each of these pushers being secured by a peg 12*a*, 13*a*, respectively. The role of these pushers 12, 13 is to push the sliding supports 9 and the yarn guides 10 along the guide rail 8. The upper pusher 12 is terminated by an oblique part 12*b* intended to push the yarn guides during the operation of transferring the yarn guides, as will be seen below.

Figure 5:
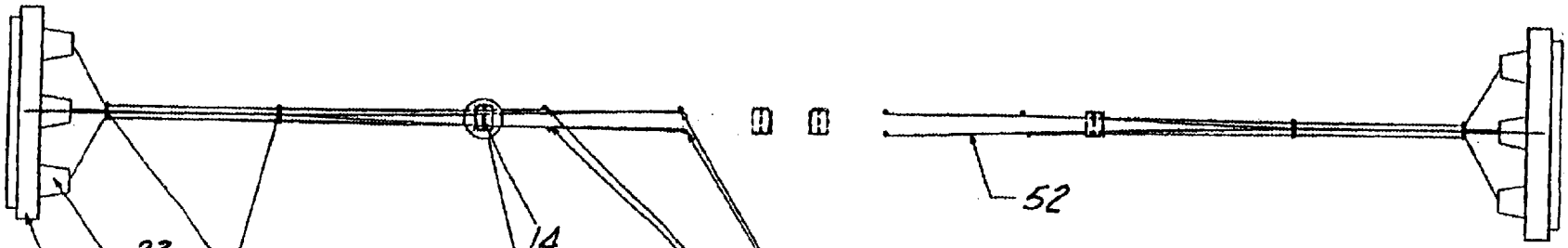
FIG. 5 is a top view of FIG. 1, illustrating only the system for transferring the yarn guides.
Figure 5B:
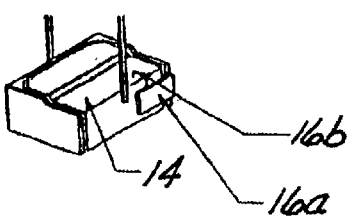
FIG. 5*b* is a perspective view of FIG. 5*a;*
Figure 5A:
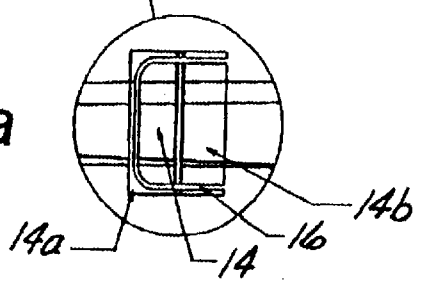
FIG. 5*a* is an enlarged view of a detail of FIG. 5.

The knitting machine further comprises members 14 for transferring the yarn guides 10 from a knitting needle 3 bed associated with one of the sections 1, 2 to the knitting needle 3 bed associated with the other of these sections 1, 2. Each of the transfer members 14 comprises two parts 14*a*, 14*b* (FIG. 5*a*), together forming a guide groove 16, each of the two parts being secured to an arm 15*a*, 15*b* of a suspension member 15 (FIG. 1). The exit end of the guide groove 16 is closed by a retractable flap 16*a*, retained by a spring 16*b* and serving to retain the yarn guide 10 when it is transferred from a knitting needle 3 bed of one of the sections to the knitting needle 3 bed of the other of the sections.

The yarn guides 10 comprise, along their stem, a guide portion 10*a*, the cross section of which is ovalized to facilitate guiding in the guide groove 16. The top of this guide portion 10*a* comprises a projection 10*b* intended to come into contact with the upper face of the transfer member 14, thus defining the vertical position of the yarn guide 10. Advantageously, the upper face of the transfer member 14 is in the shape of a cam to lift the yarn guide 10 during the transfer and thus to place it out of the range of the knitting needles 3 and to bring it back to its initial level after the transfer.

Figure 7:
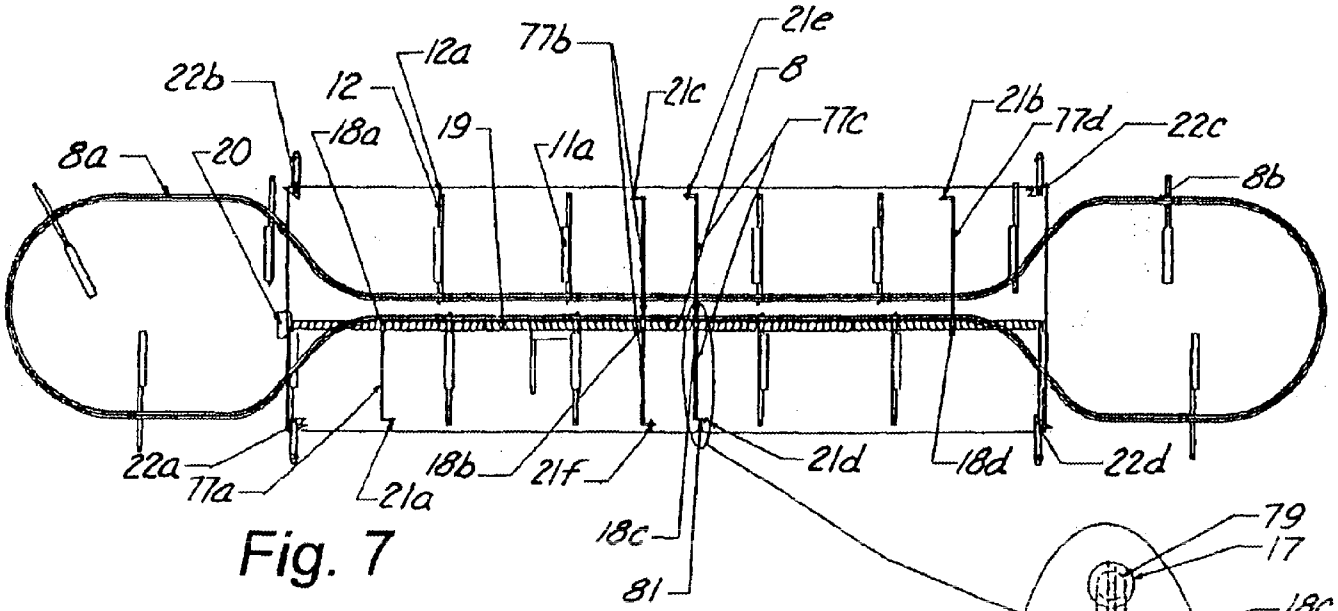
FIG. 7 is a partial top view of FIG. 1 showing only the members relating to adjusting the width of the tubular knit.

As can be noticed in FIG. 1, four transfer members 14 are placed along the sections 1 and 2. The two transfer members 14 placed at the two ends are oriented so that the ends of their guide grooves 16 face inward, that is to say that they face each other. The suspension members 15 of the two other transfer members 14 located between the end members are both secured to a drive member 17 intended to orient them angularly, as will be seen below. As will also be seen in FIGS. 1, 6 and 7, each of the suspension members 15 is also connected to an adjustment nut 18*a*, 18*b*, 18*c*, 18*d* engaged with a threaded rod 19 comprising four portions 19*a*, 19*b*, 19*c*, 19*d*, threaded with reverse pitches with respect to each other. One end of this threaded rod 19 is secured to an adjustment member 20, which may advantageously be a stepper motor. The role of this adjustment member 20 is especially to adjust the distance between the transfer member 14.

The adjustment nuts 18*a*, 18*d* bear an arm 77*a*, 77*d*, respectively, while the adjustment nuts 18*b*, 18*c* each bear two arms 77*b*, 77*c*, respectively.

Each arm 77*a*, 77*d* located at one of the ends of the sections 1, 2 bears a cam 21*a*, 21*b* (FIGS. 1 and 7) intended to engage with a peg 13*a* of the pusher 13.

Each arm 77*b*, 77*c* located in the middle part of the sections 1, 2 is associated with two cams 21*c*, 21*f* or 21*e*, 21*d*, respectively intended to engage with the same peg 13*a*, for a purpose which will be explained below.

Figure 7A:
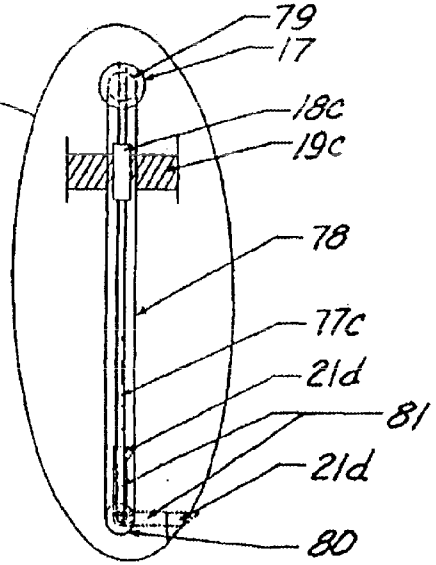
FIG. 7*a* is an enlarged view of a detail of FIG. 7.

As shown in the enlarged view of FIG. 7*a*, the cam 21*d*, borne by the arm 77*c*, is secured to the end of an arm 81, hinged at the end of the arm 77*c*. A transmission belt 78 connects a pulley 79, secured to the shaft of the drive motor 17, to a pulley 80 secured to the hinge pin of the arm 81. Thus the cam 21*d* borne by the arm 81 can be placed in two positions, an active position illustrated in dot-dash line in FIG. 7*a* and an inactive position illustrated in solid line in this same FIG. 7*a*. The other cams 21*a*–21*f* are actuated in the same way as described above for the cam 21*d*.

Each end of the guide rail 8 is terminated by a highly enlarged part 8*a*, 8*b*. At the entrance and at the exit of each of these enlarged parts, two more or less superimposed cams 22*a*, 22*b*, 22*c*, 22*d* are arranged so as to engage with the pegs 12*a*, 13*a* of the pushers 12 and 13. The role of the cams 22*a*, 22*c* located at the entrances of the respective enlarged parts 8*a*, 8*b*, is to separate the pushers 12, 13 in order to release the center of each of these enlarged parts 8*a*, 8*b* in order to allow the yarn guides to be supplied with yarn from two sets of four reels 23 (in this example) each one borne by a rotating creel 24 secured to a shaft 25.

A bevel gear transmission connects this shaft 25 to the shaft 26 of a geared drive motor M located at each end of the machine and which, by means of two respective transmission belts 27, also drive the shafts 7 of the disks 6 around which the drive chain 5 of the carriage 4 passes. Each of the pins 25 of the creels also bears a take-off 28 engaged with a transmission belt 29. A transmission shaft 30 transmits the movement received by the belt 29, using a transmission belt 31, to a rotating yarn guide 32. By virtue of this arrangement, the relative speeds of the creel 24 and of the rotating yarn guide 32 may be controlled so that the various yarns do not get entangled.

FIG. 8 again illustrates a device for the relative movement between the carriage 4 and the drive chain 5. To this end, the carriage 4 is connected to the drive chain 5 via a slide 33 secured to the carriage 4 and a slider 34 secured to the drive chain 5. A servomotor 35 serves to make a worm 36 turn while engaged with the slider 34 in order to displace it along the slide 33. The servomotor is supplied by a supply rail 37 with which a contact arm 38 comes into sliding contact.

Figure 4:
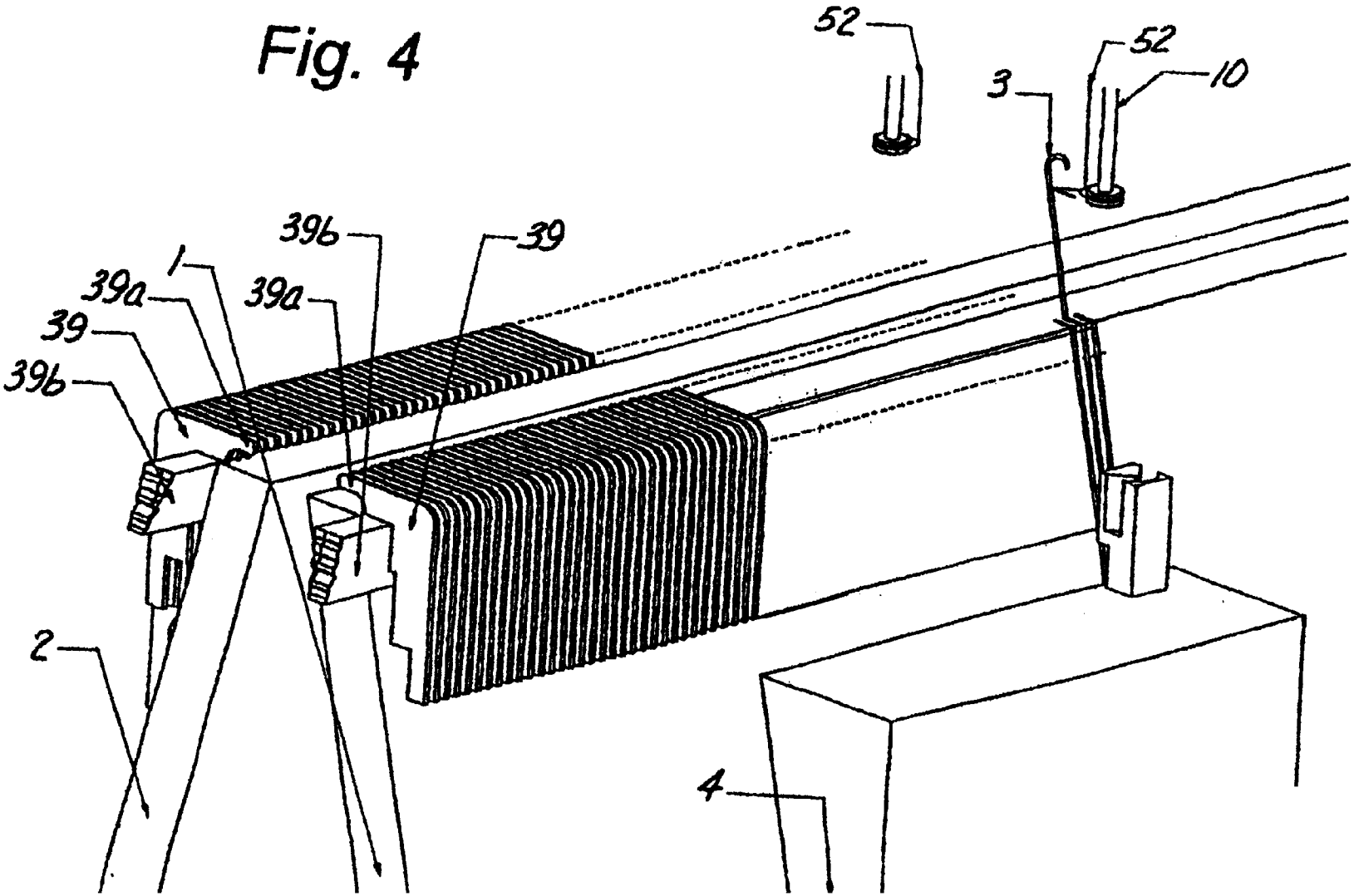
FIG. 4 is a partial view on a larger scale of a detail of FIG. 1.

Given that the knitting needles 3 do not cross, it is necessary to provide members for holding the knit during knitting. Such members 39 are visible in FIG. 4. It can be seen that they are constructed like a sort of comb allowing the knitting needles 3 and the knitting yarns to pass. Each of these holding members 39 rests on a support bar 39*b*. As can be seen in FIG. 4, the parts 39*a* of the holding members which extend above the respective upper edges of the sections 1, 2 are thinned, thus leaving space for the formation of stitches of the knit when the knitting needles 3 descend into the guide grooves of the respective sections 1, 2.

It is by virtue of these holding members 39 that it is possible to increase the clamping force on the stitches so as to produce a knit with denser stitches.

Figure 16:
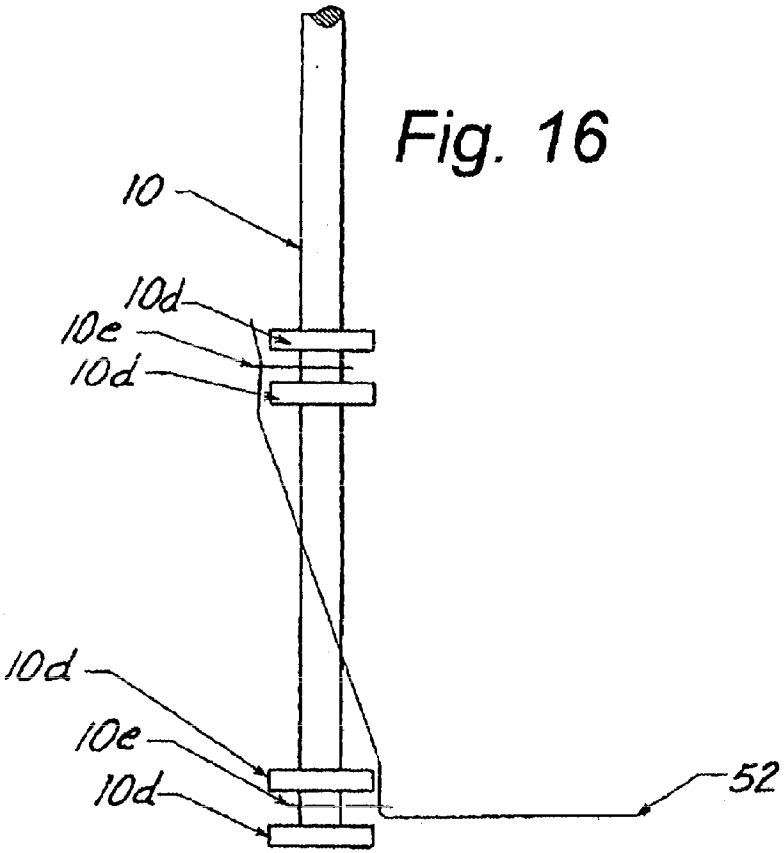
FIG. 16 is an enlarged view of a yarn guide.

FIG. 16 illustrates a detail of the guide parts of the yarn guide 10, each of which comprises a free ring 10*e* held between two annular stops 10*d*. This free ring 10*e* has a diameter which is substantially greater than that of the stem of the yarn guide 10, but less than that of the two annular stops 10*d*, such that it is free to move between these stops 10*d*. By virtue of this arrangement, the yarn guide 10 may rotate with respect to the direction of the yarn 52. Thus when the yarn guide 10 is transferred from one section to another by the transfer members 14, it rotates through 180° but, by virtue of the free ring 10*e* which holds the yarn 52, the rotation of the yarn guide 10 has no effect on the yarn 52 which may rotate with respect to the yarn guide 10 in order to retain the same orientation defined by the position of the coil supplying the yarn.

The embodiment of the knitting machine which has just been described is as follows:

In order to explain this operation, we are going to follow yarn guided by a yarn guide 10 from the moment where the latter is at the exit end of the guide groove 16 of the transfer member 14 which is located at the right-hand end of the section 1, with reference to FIG. 1. At the exit end of this guide groove 16, this yarn guide is retained by the flap 16*a*. When a sliding support 9, pushed on the guide rail 8 by the pushers 12, 13 secured to the bracket 11 fastened to the carriage 4, arrives directly above the exit of this guide groove 16, it encounters the catching member 10*c* of the yarn guide 10 retained at the exit of this guide groove 16 by the flap 16*a*. This catching member 10*c* enters through the front of the catching groove 9*a* until it stops against the pushers 12, 13 which drive the sliding support 9 along the guide rail 8. From this moment, the yarn guide 10 advances with its yarn progressively with the movement of the carriage 4 with respect to the section 1.

During its movement, the knitting cams (not shown) of the carriage 4 engage with the needles 3 which follow one another along the section 1, thus making these needles, which knit the yarn which is presented to them by the yarn guide 10, rise and fall.

When the yarn guide 10 arrives opposite the following transfer member 14, that is to say, in the example chosen, the second of the four transfer members 14 starting from the one located at the right-hand end of the section 1 in FIG. 1, its guide portion 10*a* encounters the entrance of the guide groove 16 of this second transfer member. Simultaneously, the peg 13*a* encounters the cam 21*d* (FIG. 7) which withdraws the pusher 13 slightly rearward, thus releasing the rear end of the catching groove 9*a* of the sliding support 9, only the pusher 12 remaining, by its sloped part 12*b*, in contact with the yarn guide 10.

Since the guide portion 10*a* of the yarn guide 10 is engaged in the guide groove 16 of the transfer member 14, the yarn guide 10 changes direction, while the sliding support 9, engaged with the rail 8, continues to follow a path parallel to the section 1. By virtue of its sloped face 13*b*, the pusher 13 can thus give impetus to the yarn guide 10 as it exits from the catching groove 9*a* of the sliding support 9, by the rear thereof. This impetus from the sloped face 12*b* of the pusher 12 has the effect of pushing the yarn guide 10 into the guide groove 16 of the transfer member 14, until it stops against the retaining flap 16*a*, where it waits to be taken up by another carriage 4 pushing another sliding support 9.

As to the carriage 4 and to the sliding support 9, which become separated from the yarn guide 10 engaged in the transfer member 14, it continues its movement along the section 1 in the direction of the arrow F. Immediately after having left the second transfer member 14 from the right-hand end of the section 1 (FIG. 1), the sliding support 9 driven by the carriage 4 passes by the third transfer member 14, rotates through 180° around the suspension member 15, such that the path of the guide groove 9*a* of the sliding support 9 passes through the exit end of the guide groove 16 of the transfer member 14, driving the yarn guide 10 waiting at this end into the passage.

The same knitting process as that described above takes place until the yarn guide 10 encounters the entrance of the guide groove 16 of the fourth transfer member 14 which is located at the left-hand end in FIG. 1 of the section 1. Simultaneously, the cam 21*a* (FIG. 7) moves the pusher 13 away using the peg 13*a*, and the sloped part 12*b* of the pusher 12 gives the yarn guide 10 impetus in order to transfer it toward the section 2.

The carriage 4 then arrives at the left-hand end (FIG. 1) of the section 1 and it is now driven by the chain 5 toward section 2 by rotating around the disk 6. As to the sliding support on the rail 8, it approaches the widened part 8*a* of the guide rail 8. At the start of this widened part, the pegs 12*a*, 13*a* of the pushers 12 and 13 encounter two cams 22*a* which withdraw these pushers 12 and 13 outward from the loop 8*a* in order to release the center therefrom and allow passage of the knitting yarn passing from the rotating yarn guide 32 to the yarn guides 10.

Once the carriage 4 finishes its rotation, the pegs 12*a*, 13*a* encounter a cam 22*b* (FIG. 7) which returns the pushers 12 and 13 into their initial position, such that when the catching groove 9*a* of the sliding support 9 passes directly below the exit of the guide groove 16, the catching member 10*c* of the yarn guide 10 is inserted in this catching groove 9*a* and is driven along the rail 8, with the sliding support 9, by the pushers 12 and 13.

Given that the knitting yarn is transferred without cutting this yarn, from a knitting needle 3 bed of one of the sections 1, 2 to the knitting needle 3 bed of the other of these sections, while rotating constantly in the same direction, a tubular knit is formed and, as there are two pairs of transfer members 14 placed along the sections 1 and 2, it is thus possible to form two tubular knit elements side by side, which may advantageously constitute the two legs of a seamless pair of pants, boxer shorts or tights. Once the length of the legs is reached, it is enough to select the knitting needles 3 which are between the two transfer members 14, using conventional selection means which are not shown because they are not part of the present invention.

At the same time as the aforementioned knitting needles 3 are selected, the two transfer members 14 are rotated through 90° using motors 17, such that the yarn guides 10 can no longer engage in the guide grooves 16 and that only the transfer members 14 placed at the two ends of the sections 1, 2 are still in service. Hence, the two tubular knit elements forming the legs of the pair of pants, the boxer shorts or the tights are joined into a single tubular element forming the top of the pair of pants, boxer shorts or tights. Simultaneously, given that, from this moment, each knitting yarn makes a complete rotation of the sections over their entire width rather than only over half of this width, the geared drive motors M will drive the creels 24 at half speed.

Given that the speed at which the carriages 4 are driven by the endless drive chain 5 is constant, the servomotors 35 associated with each carriage 4 make it possible to reduce or increase the rate of movement of these carriages 4 in order to make it possible to synchronize them. This is because, in the example described, each creel 24 bears four reels 23 supplying knitting yarn, which corresponds to four yarns per knitted leg and to eight yarns when knitting the top of the pair of pants. Given the increases and decreases in the width of the knit, it may be necessary to modify the speed of the carriages 4 in order to take the yarn guides 10 to the exit of the transfer members 14.

However, before the carriage 4 starts to rotate around the drive disks 6 in order to operate with the opposite section, the servomotor 35 must put the carriage 4 back into the zero position, that is to say, in the position where it is neither advanced or retarded with respect to the reference spacing between the carriages 4.

When the knitting needles 3 are selected for the purpose of increasing or reducing the diameter of the tubular knitted element or elements, it is necessary to change the positions of the transfer members 14 so that they follow these changes in diameter. This adjustment is carried out by the worm 19 and the stepper motor 20. Since the threads of the various portions 19*a*, 19*b*, 19*c*, 19*d* of the worm are reversed, when the two legs of the pants are knitted, depending on the direction of the rotation of the worm 19, the paired transfer members 14 defining the two legs of the pants come together or move apart from each other. Similarly, when knitting a single tubular element forming the top of the pair of pants, where the two transfer members 14 located in the middle part of the sections 1, 2 are taken out of service, as explained above, the two transfer members 14 located at the ends of these sections 1, 2 come together or move apart from each other depending on the direction of rotation of the adjustment screw 19.

Figure 17:
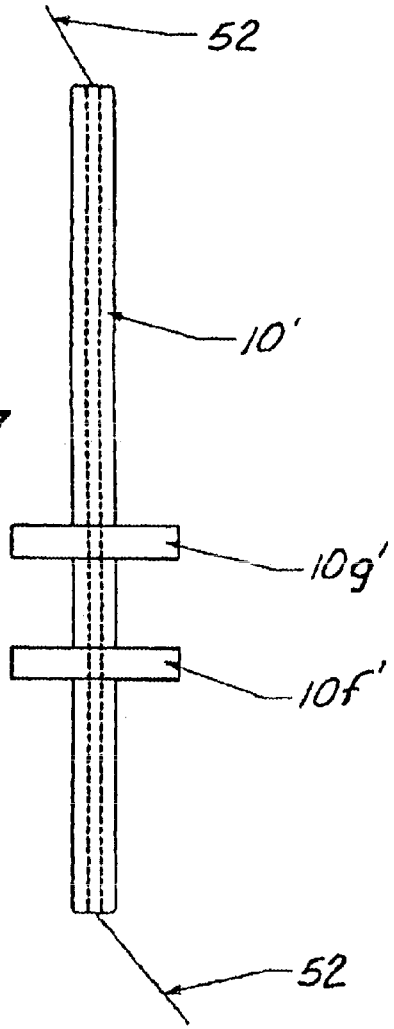
FIG. 17 is a view of a variant of the yarn guide illustrated in FIG. 16.

In a variant illustrated in FIG. 17, to prevent the yarn 52 winding around the rotating yarn guide, when the latter follows the tubular shape of the knit and thus changes orientation with respect to the portion of yarn located between the movable yarn guide 10 and the yarn guide 32, it is also possible to use a tubular yarn guide 10'. The yarn 52 enters by one end of the tube of the yarn guide 10' and exits by the other end.

Such a yarn guide 10' may therefore change orientation with respect to the stationary yarn guide 32 without the yarn becoming wound around it. Such a yarn guide 10' may advantageously comprise two disks 10'*f* and 10'*g*, one 10'*f* serving to support the yarn guide 10' on a carriage (not shown) and the other to engage with a transfer arm (not shown).

The second embodiment will now be described with reference to FIGS. 9 to 15. Several of the changes described in relation to this embodiment may be used in the previous embodiment. Similarly, several of the elements described with respect to the first embodiment may be used in the second embodiment.

The fundamental difference between these two embodiments resides in the fact that, instead of moving in a horizontal plane, the carriages 40 in the second embodiment move in two vertical planes, such that this embodiment requires twice as many carriages as the first embodiment. Another noticeable difference is seen in the creels for the reels supplying knitting yarn.

Figures 9, 10:
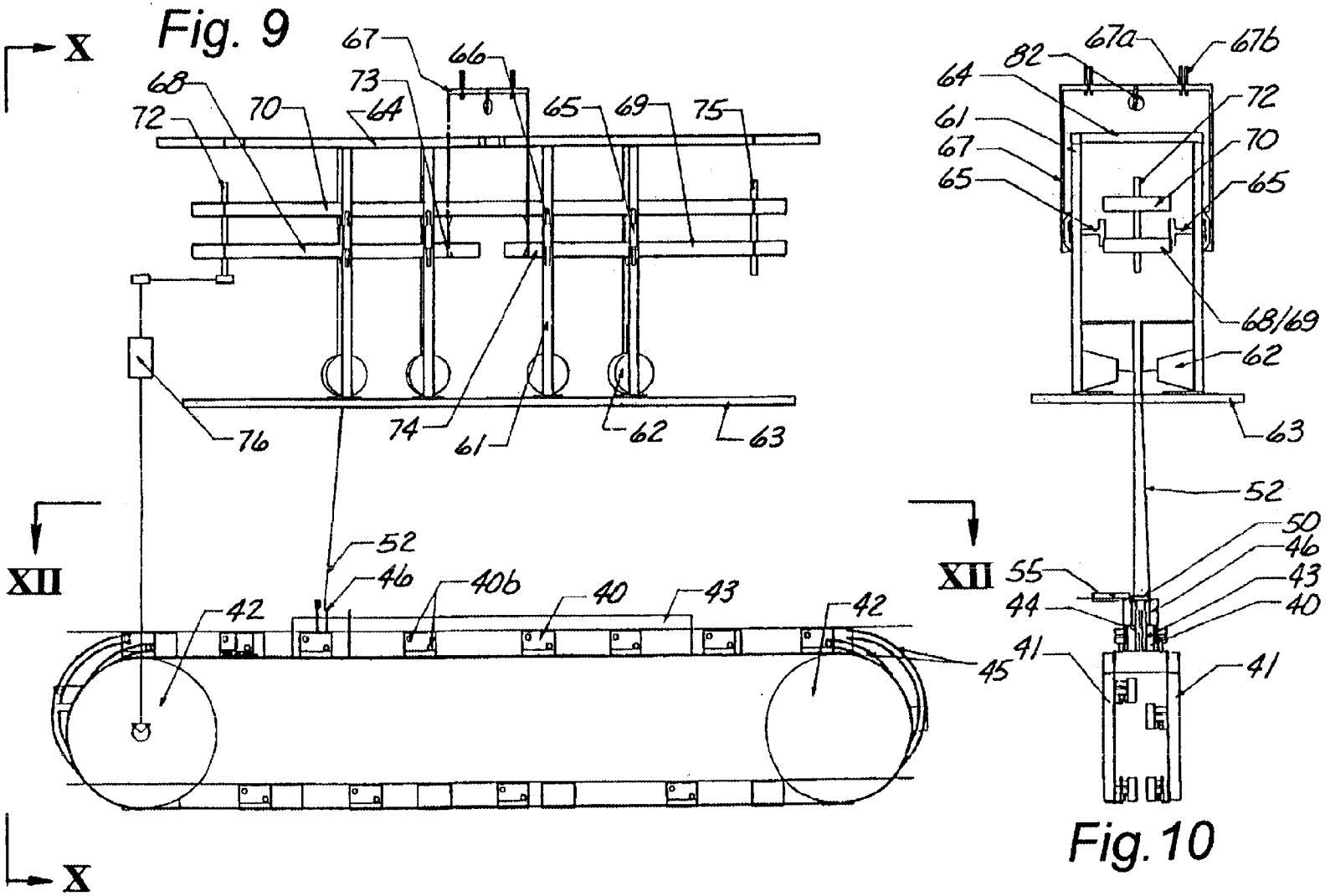
FIG. 9 is a view in side elevation of the knitting machine according to the second embodiment.
FIG. 10 is a view along X—X of FIG. 9.

FIG. 9 shows an endless drive chain 41 forming a closed loop around two wheels 42 with horizontal pivot pins. A second identical chain forms a second parallel loop, placed on the other side of the two vertical sections 43, 44, as can be seen in particular in FIG. 10. The carriages 40 are each connected to one of the chains 41 by a pin 40*a* transverse to this chain, enabling them to pivot. Each of these carriages 40 also bears two guide pegs 40*b*, intended to engage with two guide rails 45 placed at the two ends of the closed loop described by the carriages 40. These carriages 40 therefore have three guide points, the pin 40*a* and the pegs 40*b*, such that, by virtue of the guide rails 45, they can move from the upper horizontal part of their path to the lower horizontal part, while constantly remaining in a horizontal position both when going from the top downward of their path and from the bottom upward.

Figure 13:
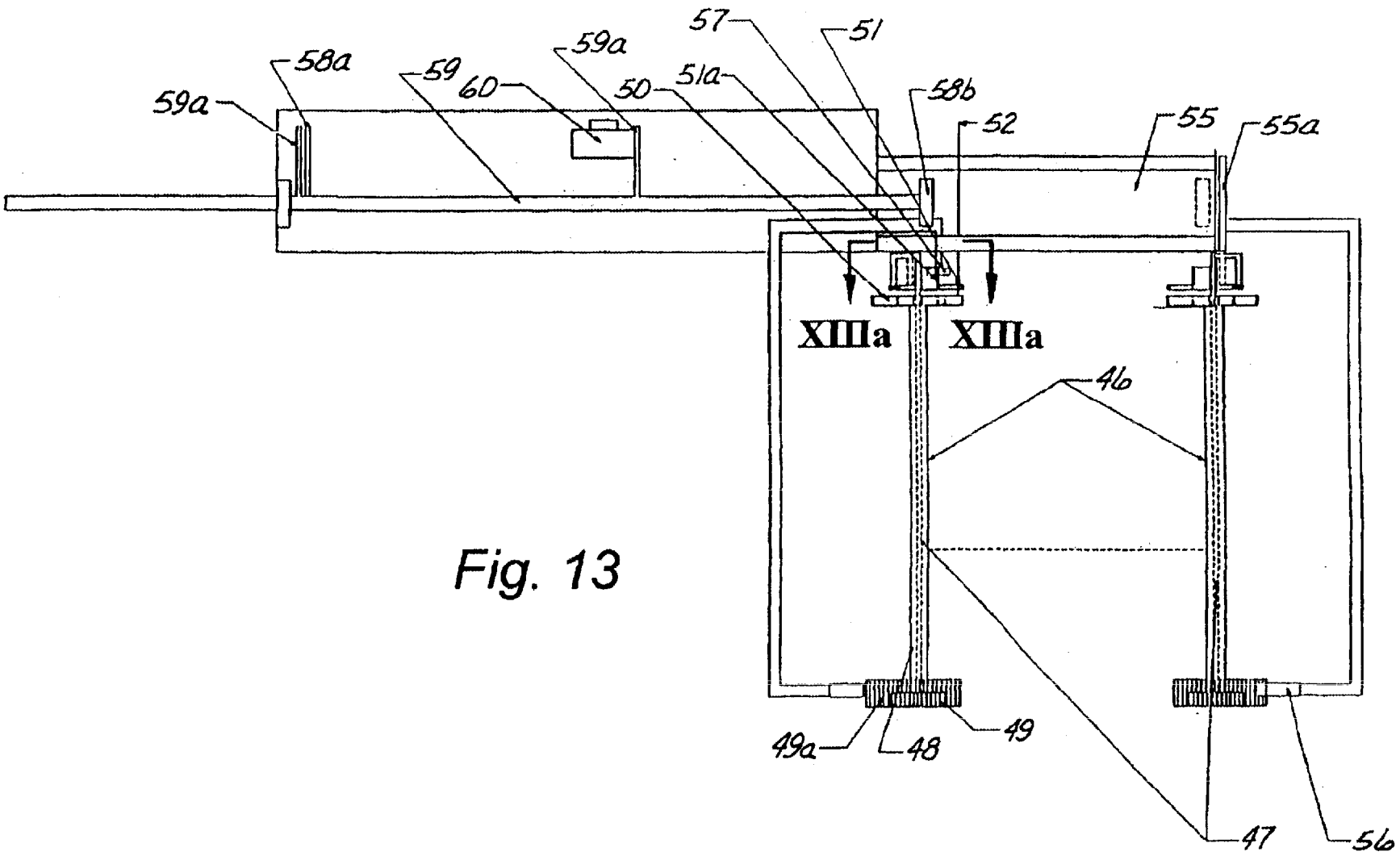
FIG. 13 is a view along XIII—XIII of FIG. 12.
Figure 14:
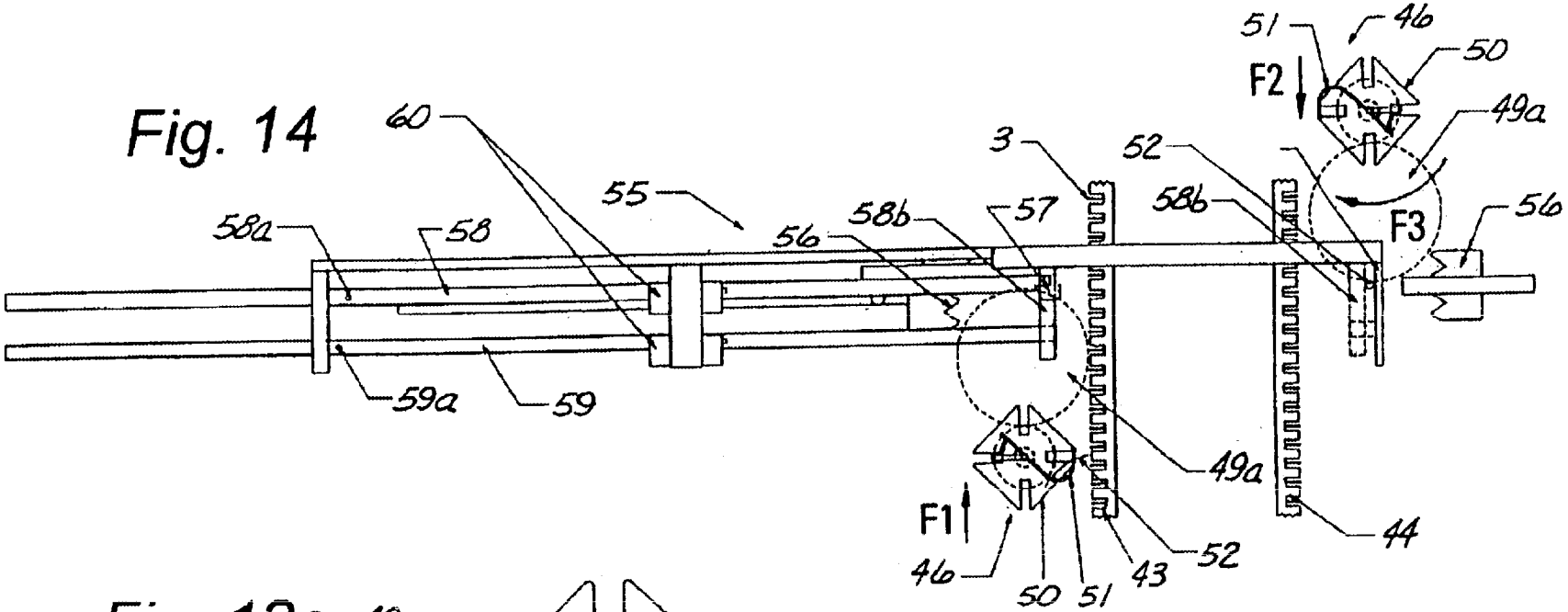
FIG. 14 is a top view of FIG. 13.
Figure 13A:
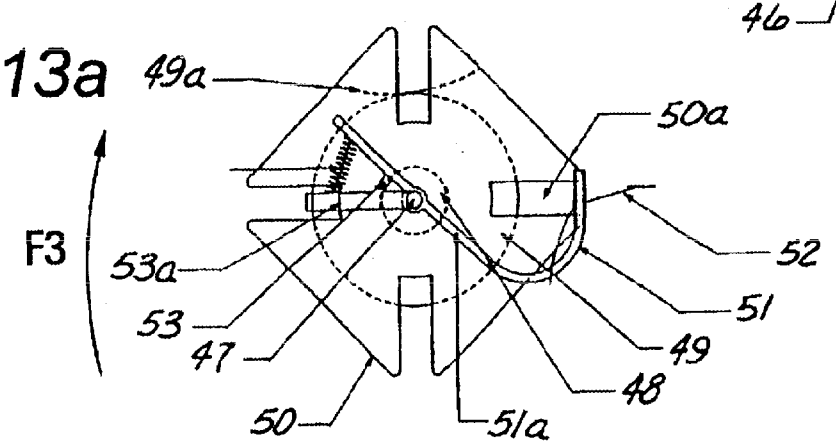
FIG. 13*a* is a top view of the enlarged portion of FIG. 13.
Figure 15:
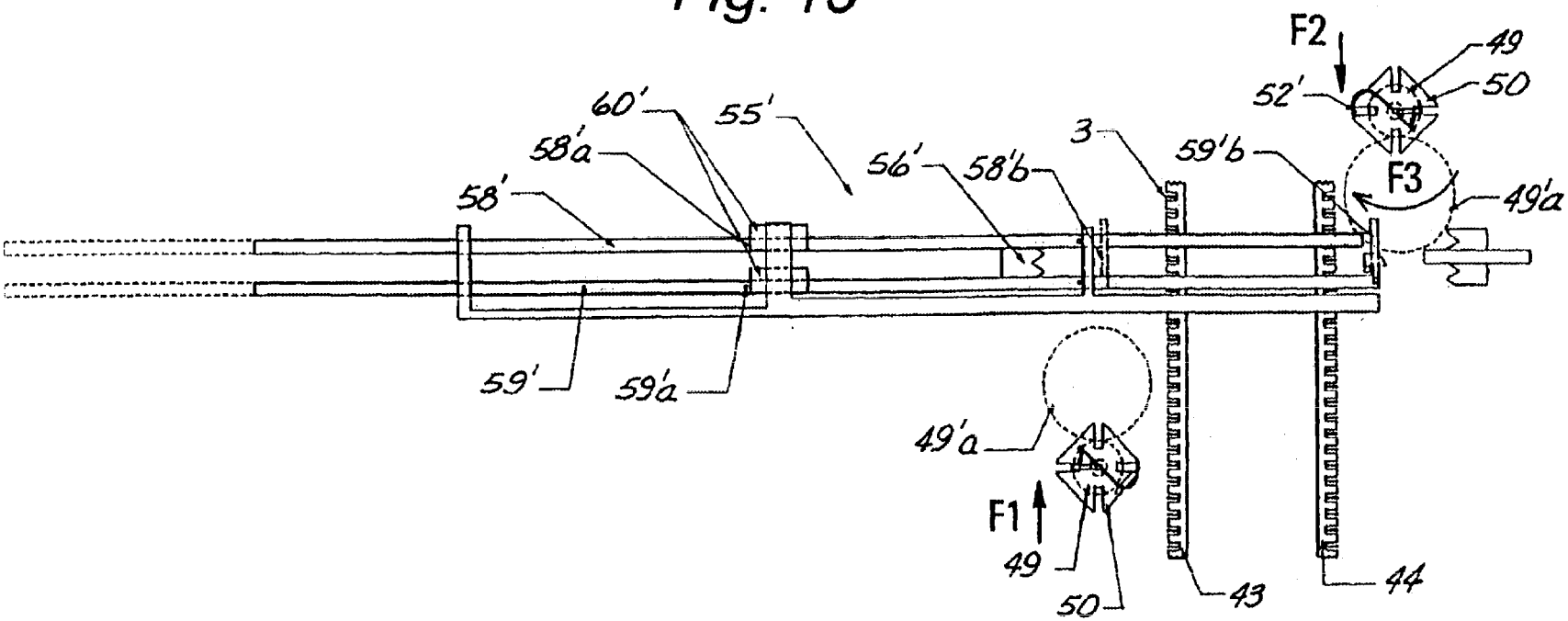
FIG. 15 is a view similar to FIG. 14 of a second yarn transfer station.

Unlike the previous embodiment where the transfer of the yarn from one section to the other is carried out by transferring the yarn guides, in this embodiment, only the yarn is transferred, the yarn guides 46 being secured to the carriages 40. As illustrated in FIGS. 13, 13*a*, and 14, the yarn guide 46 is fastened to the carriage 40 by a post 47 around which a tubular body 48 pivots. This tubular body 48 is terminated by a pinion 49 at its lower end and by a yarn retaining element 50 consisting of a member provided with four radial notches 50*a* reminiscent of a Maltese cross, at its upper end. The pinion 49 engages with a take-off 49*a* mounted so that it can pivot on the carriage 40. The upper end of the post 47 bears a member 51 for locking the knitting yarn 52. This locking member 51 is mounted so that it can pivot on this post 47 and is normally applied against a stop 53 secured to an arm 53*a* itself secured to the post 47. A return spring 54 tends constantly to keep the locking member applied against the stop 53.

There are four transfer stations 55 (FIGS. 12, 13, 14 and 15), equivalent to the transfer members 14 of the first embodiment, so that the knitting yarn can be transferred from one section to the other, at each end of the knitting travel, corresponding to half a portion of tubular knit. The two transfer stations 55 located in the middle part of the sections can be taken out of service to allow the top of the pair of pants to be knitted. As with the transfer members 14, the transfer members 55 of the second embodiment are engaged with adjustment screws 19', 19", controlled by motors 20', 20", in order to vary the width of the knit.

Each transfer station 55 comprises two racks 56 located on the respective paths of two take-offs 49*a*. A release cam 57 is again placed on the path of a portion 51*a* of the member 51 for locking the knitting yarn 52, on the side where this yarn must be released from the yarn guide 46 in order to be transferred to the other section. In the example described, this release cam 57 is located to the left with reference to FIG. 13.

The frame of this transfer station 55 also comprises two transfer slides 58, 59, each one bearing two stops 58*a*, 59*a*, respectively, intended to limit their respective travels. Two actuating members 60 serve to actuate these slides from one stop to the other and vice versa. The free end of the transfer slide 58 is also secured to a pusher 58*b* fitted with an opening for passage of the other slide 59. The pusher 58*b* may be moved by the transfer slide 58 up to a stop surface 55*a* secured to the frame of the transfer station 55.

Figure 11:
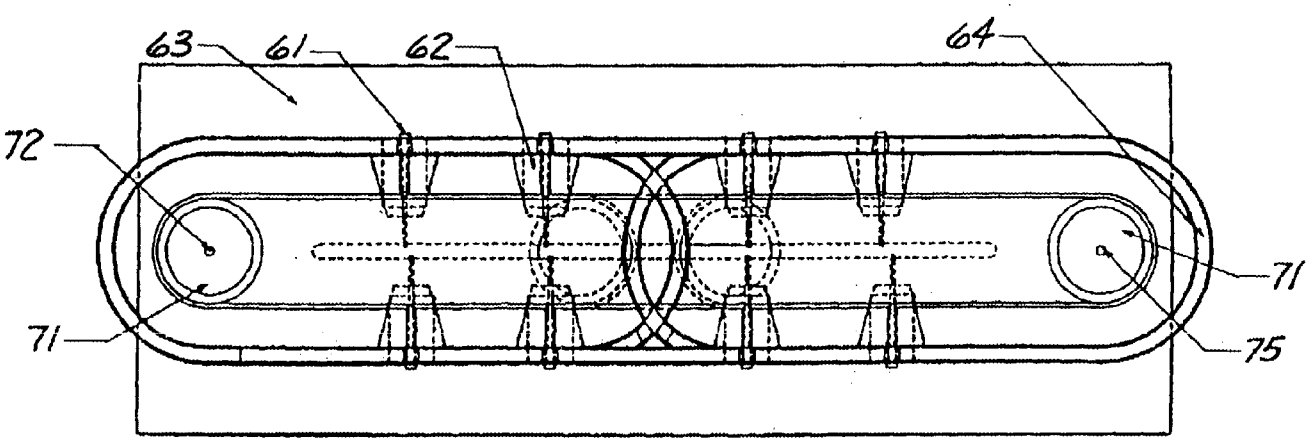
FIG. 11 is a top view of FIG. 9.
Figure 12:
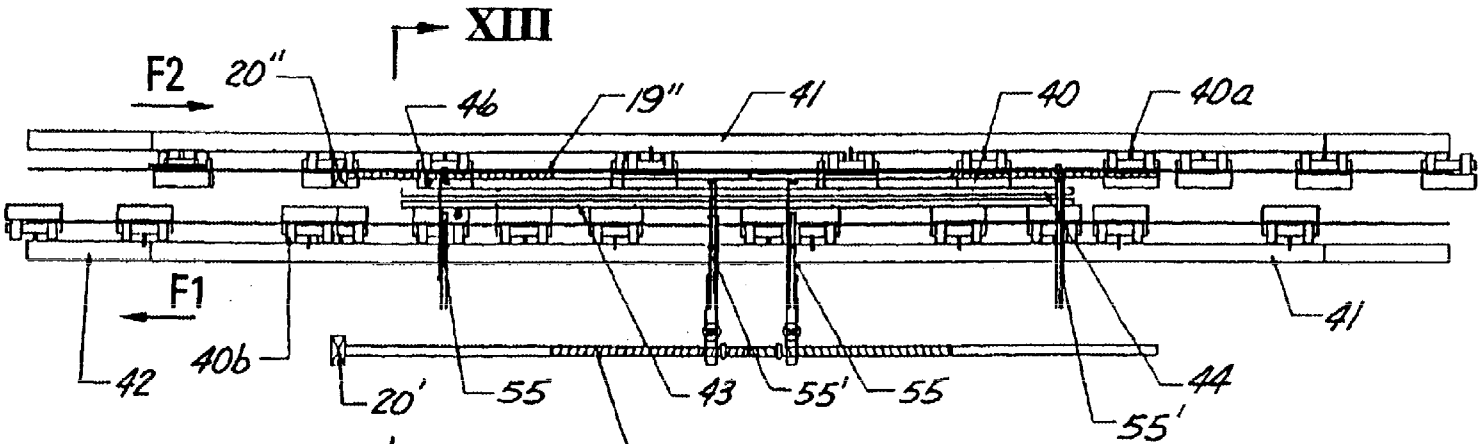
FIG. 12 is a view along XII—XII of FIG. 9.

FIGS. 9 to 11 show another creel device intended to supply the knitting yarns by making them rotate always in the same direction, in this case, clockwise (FIG. 11), and by allowing the knitting yarns to rotate around the two respective rotating pins while knitting the legs of the pants, then around a single pin when knitting the top of the pair of pants.

This creel device comprises vertical reel supports 61, each one of which bears a reel 62 of knitting yarn 52. Each vertical support 61 rests on a support surface 63 while it is guided upward by a guide rail 64. This guide rail forms, as illustrated in FIG. 11, two small oval loops included within a large oval loop. The two small oval loops are intended to guide the reel supports 61 when knitting the trouser legs, while the large loop is intended to guide them when knitting the top of the pair of pants.

Each vertical support 61 comprises a connection member 65, mounted so that it can slide in a vertical groove 66 (FIG. 9). A slide 67 secured by guide pegs 67*a* engaged with guide grooves 67*b* and actuated by a crank mechanism 82, serves to move the connection member 65 in this vertical groove 66.

The inner end of this connecting member 65 is shaped so as to engage selectively with flexible drive members 68, 69, 70 (FIGS. 9, 10), forming three endless loops, like the guide rail 64, while passing round wheels 71 pivoted around vertical pins 72, 73, 74, 75. The pin 72 is connected to a geared motor 76 also connected to one of the wheels 42 for guiding and driving the chain 41. This geared motor 76 makes it possible to vary the drive speed of the pin 72, depending on whether the supports 61 rotate along the two small loops of the guide rail 64 or along the large loop, that is to say, whether they are engaged with the drive members 68, 69 or with the drive member 70.

Figure 8:
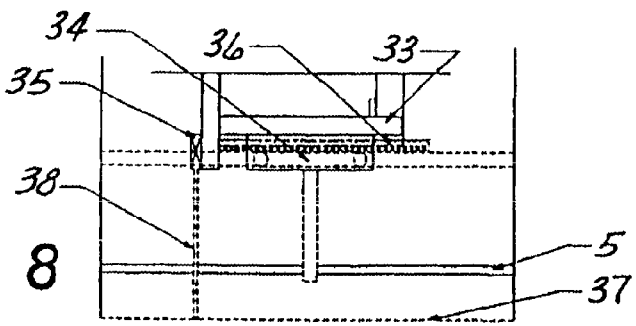
FIG. 8 is a partial top view of a detail of a carriage for controlling the knitting needles, showing a device for displacing this carriage with respect to its drive mechanism.

As in the previous embodiment, the carriages 40 are connected to the drive chains 41 by a servocontrol system as illustrated in FIG. 8, making it possible to vary the speed of the carriages with respect to that of the drive chains 41.

To explain the operation of this second embodiment, we will start with a carriage 40 moving in the direction of the arrow $F_1$ (FIG. 12) and arriving at the transfer station 55 which is located toward the left-hand end of the sections 43, 44. This part of the knitting machine is illustrated in more detail in FIGS. 13 and 14 to which reference may be made. The carriage 40, which moves in the direction of the arrow $F_1$, bearing the yarn guide 46 which drives the knitting yarn 52, is at the point of arriving at the transfer station 55, while the carriage 40 which is moving in the direction of the arrow $F_2$ bearing the yarn guide 46 empty of knitting yarn also arrives at the transfer station 55.

On arriving at this transfer station 55, the take-off 49*a* of the yarn guide 46 moving in the direction of the arrow $F_1$ encounters the rack 56 which makes the yarn retaining member 50 rotate in the direction of the arrow $F_3$ (FIG. 13*a*). Virtually simultaneously, the part 51*a* of the locking member 51 of the knitting yarn 52 (FIGS. 13, 14) encounters the cam 57 which makes this locking member 51 rotate counter to the tensile force of the spring 54, such that the locking member 51 rotates in the direction of the arrow $F_3$ (FIG. 13*a*), releasing the radial notch 50*a* and thus freeing the knitting yarn 52.

As soon as it is freed, the knitting yarn 52 is then moved by the pusher 58*b* against the stop surface 55*a* and the slide 59 closes the space in which the knitting yarn is enclosed, as is shown in dotted line in FIG. 14. The yarn is then positioned to be taken into a radial groove 50*a* of the yarn retaining member 50 which is moved in the direction of the arrow $F_2$, as illustrated in FIG. 14. Virtually simultaneously, the rack 56 encounters the take-off 49*a* which makes the retaining member 50 of the knitting yarn 52 rotate through 90° in the direction of the arrow $F_3$, which is locked by the locking member 51.

The same transfer operation is then carried out in the reverse direction when the carriage 40, which moves in the direction of the arrow $F_2$, has reached the transfer station 55', which is located in the middle part of sections 43, 44. The transfer station 55' differs from the station 55 of FIG. 14 only in that, in order to transfer the knitting yarn 52 from the section 44 to the section 43, it is the slide 59' with an arm 59'*b* at 90° which must take the yarn 52' from right to left instead of pushing it from left to right as the pusher 58*b* of FIG. 14 does. The rest of the operations are the same such that reference may be made to FIG. 14.

Symmetrical operations are carried out on the knitting yarns, knitted on the right half of the sections 43, 44. When the legs of the pants or tights are completed and when it is necessary to pass to the top of the pair of pants, the two transfer stations 55, 55' located in the middle of the sections 43, 44 are taken out of service and the knitting yarns 52 are transferred only at the two ends of the sections 43, 44.

The reels 62 are moved on the creel by following the movement of the yarn guides 46 driven by the carriages 40. When knitting the trouser legs, the connection members 65 of the supports 61 for reels 62 are connected to the flexible drive members 67, 68, respectively, and are guided along the two small elongated loops formed by the guide rail 64. When the top of the pair of pants are knitted, the connection members 65 are connected to the flexible drive member 70 by the actuating members 67 and then describe a single elongated path.

In the two embodiments described above, each section is made as a single part. In a variant (not shown), it would be possible to use sections in two parts capable of being moved laterally one with respect to the other according to a system known in rectilinear knitting machines. By virtue of this type of section, after having knitted the two tubular parts, the two section parts could be joined to knit the common tubular part, corresponding to the top of the pair of pants.

What is claimed is:

1. A method of forming a seamless tubular knit of variable diameters on a rectilinear knitting machine in which the stitches are formed by a descent of knitting needles, comprising two parallel straight sections for guiding said knotting needles, means of selecting these knitting needles for increasing or reducing the diameter if the tubular knitted element or elements when knitting it or them, carriages for moving the selected knitting needles and members for guiding the knitting yarn, comprising the steps of placing the two sections so that the needles of one of the two sections do not cross the needles of the other of the two sections during their normal knitting travel;

moving said carriages in a single direction along each of the two sections, the direction of movement of said carriages along their respective sections being opposite to each other;

supply a knitting yarn associated with each carriage moving with respect to a succession of selected needles of one of the two sections in order to form part of a tubular knit;

transferring the yarn from the needles of one of the two sections to those of the other of the two sections, each time said yarn arrives at the end of said succession of selected needles, by combining it with another carriage located at the start of a succession of needles selected from said other of the two sections in order to form the other part of said tubular knit; and changing the transfer positions or said yarn each time the diameter of said tubular element or elements is increased or reduced.

2. The method as claimed in claim 1, further comprising the steps of:

selecting two sets of needles on each of the two sections, each of the two sections facing one another, separating the two sets of needles of each of the two sections from each other by unselected needles, knitting two tubular elements side by side transferring the yarn from one of the two sections to the other of the two sections each time of arrives at one end of one of said sets of selected needles, then, having reached the desired length for said tubular elements side by side, selecting the needles separating said two sets of needles join said tubular elements side by side and to form only a single tubular element.

3. A rectilinear knitting machine, comprising:

two sections for guiding knitting needles defining needle paths according to which the needles of one of the two sections do not cross the needles of the other of the two sections, means for selecting at least one set of consecutive knitting needles on each of the two sections for increasing or reducing the diameter of the tubular knitted element or elements when knitting it or them in order to engage said needles with drive cams secured to carriages, means for guiding and driving these carriages in order to move them in a single direction with respect to said set of needles selected from each of the two sections, from the start to the end of this set of needles and to make them pass from the end of one set of selected needles to the start of the same set or from the other set of selected needles, means for making a knitting yarn pass from the needles of one of the two sections to those of the other of the two sections at the end of each set of selected needles, and means for changing the positions of said means for making said knitting yarn pass each time the diameter of said tubular knitted element or elements is increased or reduced.

4. The knitting machine as claimed in claim 3, wherein said means for guiding said carriages form a closed loop extending in a plane substantially perpendicular to said two sections.

5. The knitting machine as claimed in claim 3, wherein said means for guiding said carriages forms two closed loops in two parallel vertical planes.

6. The knitting machine as claimed in claim 3, wherein said means for making the knitting yarn passes from the needles of one of the two sections to those of the other of the two sections at the end of each set of selected needles comprises yarn guides removably connected to slideways engaged with a portion of a guide rail parallel to said two sections and members for separating the yarn guides from said slideways and for engaging them with slideways located on a portion of said guide rail parallel to the other of the two sections.

7. The knitting machine as claimed in claim 3, wherein said means for making the knitting yarn passes from the needles of one of the two sections to those of the other of the two sections at the end of each set of selected needles comprises elements for grasping the knitting yarn, means for guiding these grasping elements, forming two parallel segments, each one running alongside one of said two sections, means for transferring the freed knitting yarn to a grasping element engaging said parallel segment running alongside the other of said two sections, and means for engaging said knitting yarn with said grasping element to which it has been transferred.

8. The knitting machine as claimed in claim 3, further comprising means for retaining the knit on each of the two sections counter to the movement of the needles with respect to said sections.

9. The knitting machine as claimed in claim 3, wherein said yarn guide comprises at least one ring of substantially larger diameter than that of the yarn guide placed between two annular stops having diameters greater than that of said ring.

10. The knitting machine as claimed in claim 3, comprising supports for reels mounted on guide means along closed-loop paths, and drive means for driving these supports along said paths in synchronization with the movement of said yarn guides.

11. The knitting machine as claimed in claim 3 wherein each of said carriages is connected to a flexible drive element via means for moving the carriages in a direction parallel to said flexible drive element.

12. The knitting machine as claimed in claim 3, if wherein the yarn guide is a tubular element open at both ends, a tubular pipe of which serves to guide the yarn.

13. A pair of pants, boxer shorts or tights obtained by implementing the method as claimed in claim 1.

* * * * *